United States Patent [19]

Iguchi

[11] 3,942,492

[45] Mar. 9, 1976

[54] CENTRIFUGAL IGNITION ADVANCER DEVICE FOR AN IGNITION SYSTEM OF AN INTERNAL COMBUSTION ENGINE

[75] Inventor: Masaru Iguchi, Katsuta, Japan

[73] Assignee: Hitachi, Ltd., Japan

[22] Filed: Feb. 13, 1975

[21] Appl. No.: 549,741

[30] Foreign Application Priority Data

Feb. 15, 1974 Japan ..... 49-17569

[52] U.S. Cl. ..... 123/117 R; 64/25; 200/31 CA

[51] Int. Cl.[2] ..... H01H 19/62

[58] Field of Search ..... 200/31 CA; 64/25; 123/117 R

[56] References Cited

UNITED STATES PATENTS

| | | | |
|---|---|---|---|
| 2,215,301 | 9/1940 | Schneider | 200/31 CA |
| 2,699,657 | 1/1955 | Vogel | 200/31 CA |
| 3,202,777 | 8/1965 | Scott | 200/31 CA |
| 3,715,528 | 2/1973 | Habert | 200/31 CA |
| 3,791,171 | 2/1974 | Hofman | 200/31 CA |
| 3,834,184 | 9/1974 | Hofmann et al. | 200/31 CA |

*Primary Examiner*—Wendell E. Burns
*Assistant Examiner*—James W. Cranson, Jr.
*Attorney, Agent, or Firm*—Craig & Antonelli

[57] ABSTRACT

A centrifugal ignition advancer device adapted to advance the ignition timing of an internal combustion engine according to the engine speed comprising two weights adapted to be displaced in accordance with the speed of revolution of a distributor shaft, and two springs differing from each other in initial tension and spring constant, one of the two weights being maintained in its initial position by one of the two springs while the other weight is maintained in its initial position by the other spring. Only one weight is displaced so that the rate of increase in the degree of advance of ignition timing in relation to a change in engine speed can be kept at a lower level at lower engine speeds and the two weights are both displaced so that the rate of increase in the degree of advance of ignition timing in relation to a change in engine speed can be maintained at a higher level at higher engine speeds.

3 Claims, 6 Drawing Figures

CENTRIFUGAL IGNITION ADVANCER DEVICE FOR AN IGNITION SYSTEM OF AN INTERNAL COMBUSTION ENGINE

This invention relates to centrifugal ignition advancer device for an ignition system for an internal combustion engine, and more particularly it is concerned with an ignition advancer device of the type which enables to adjust ignition timing of the engine in such a manner that exhaust emission control can be effected satisfactorily to avoid air pollution.

Proposals have in recent years been made to effect adjustments of ignition timing of an internal combustion engine so that the engine can be made to operate efficiently while effecting exhaust emission control to avoid air pollution by exhaust gases.

Heretofore, attempts have been made to vary the ignition advance characteristic in order to maximize the output power of an engine. For example, in one method known in the art, a centrifugal weight which is caused to be displaced in accordance with the prevailing engine speed is combined with an ignition advancer plate which is formed therein with a slot of a special shape for transmitting the displacement of the weight to a cam shaft by converting the displacement of the weight into a specific characteristic. In another method known in the art, a centrifugal weight is used in combination with special springs whose spring constants undergo a change when the displacement of the weight takes place.

These methods of the prior art are all intended to obtain a characteristic for producing maximum engine output power, and not designed to obtain an ignition advance characteristic which enables exhaust emission control to be effected satisfactorily to avoid air pollution by exhaust gases. Therefore, none of these methods can have application as they are in an internal combustion engine which is designed to effect exhaust emission control satisfactorily.

It is possible to design the slot formed in the ignition advance plate in such a manner that its shape suits the ignition advance characteristic adapted for effecting exhaust emission control. However, this method essentially has a drawback in that ignition advance does not take place smoothly at a turning point of the slot, thereby making it difficult to effect exhaust emission control with a high degree of precision. Moreover, once the shape of the slot is selected, it is difficult to effect adjustments of the ignition advance characteristic. Thus, it becomes necessary to effect replacement of ignition advancer plates.

In the method in which the slot formed in the ignition advance plate is linear in shape and the springs for supporting the centrifugal weight have a special characteristic, a plurality of spring must be used in combination with one weight, and the characteristic obtained by carrying this method into practice has been such that the degree of ignition advance is high at low engine speeds and low in high engine speeds. Such characteristic can be obtained by successively rendering the plurality of springs operative. However, this method of the prior art has the disadvantage of being unable to produce a characteristic which is opposite to the aforementioned characteristic or characteristic in which the degree of ignition advance is low at low engine speeds and high at high engine speeds.

Thus, there has been a demand for an automatic ignition advancer device for an internal combustion engine which does not appreciably reduce the efficiency with which the engine operates while permitting control of exhaust emission to be carried out satisfactorily, but no device has ever been developed which can meet such demand.

This invention has as its object the provision of an automatic ignition advancer device of the centrifugal force type for an ignition system of an internal combustion engine which permits ignition advance to be effected smoothly depending on the prevailing condition, and which permits to obtain by a simple mechanism an ignition characteristic which is amenable to fine adjustments and conductive to improved exhaust emission control without reducing operation efficiency of the engine.

The outstanding characteristic of the invention is that a pair of springs differing from each other in initial tension and spring constant are employed, each spring being connected to a corresponding weight and only one weight being caused to be displaced at a predetermined engine speed range while the two weights are both caused to be displaced at engine speeds above such predetermined speed range, the other weight being constructed such that it does not interfere with the displacement of one weight which is rendered operative in advance of the other weight.

Figure 1:
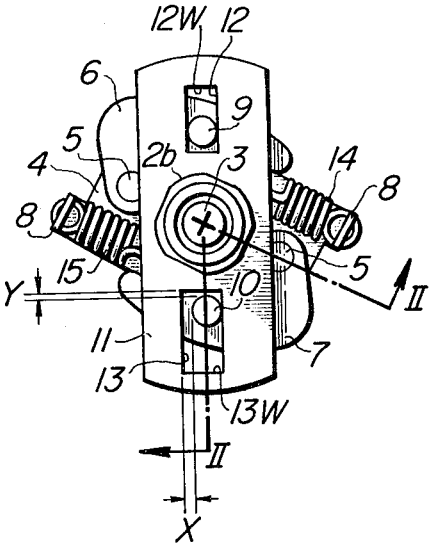
FIG. 1 is a plan view of the centrifugal ignition advancer device comprising one embodiment of the invention.
Figure 2:
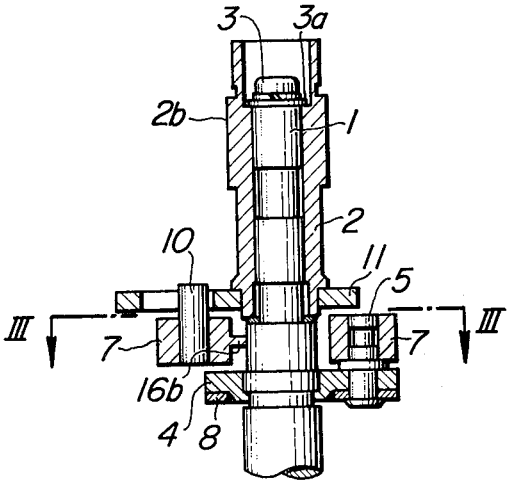
FIG. 2 is a sectional view taken along the line II of FIG. 1.

A preferred embodiment of the present invention will now be described with reference to the accompanying drawings. 1 designates a shaft which rotates synchronously with the engine speed of the internal combustion engine. Pivotally supported at an upper end portion of the shaft 1 is a cam cylinder 2 which is held in place by a screw 3 and a washer 3a and kept from being dislodged from the upper end portion of the shaft 1. The cam cylinder 2 is formed therein with a cam surface 2b for turning on and off an interruptor (not shown).

Figure 3:
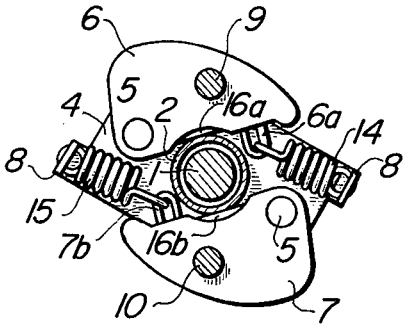
FIG. 3 is a transverse sectional view taken along the line III — III of FIG. 2.

A weight support member 4 is attached to a lower end of the shaft 1 as by being force fitted in the shaft and has secured thereto a pair of weight support shafts 5, 5. The shafts 5, 5 pivotally support centrifugal weights 6 and 7 respectively. The weights 6 and 7, which are each of a shape shown in FIG. 3, have secured thereto upwardly extending rods 9 and 10 and spring connecting portions 6a and 7b respectively. Spring connecting plates 8, 8 are formed integrally with the weight support member 4 and disposed near the shafts 5, 5, with opposite ends of each plate 8 being bent upwardly. A spirng 14 is mounted between the spring connecting portion 6a of the weight 6 and the end of one of the spring connecting plates 8 while another spring 16 is mounted between the spring connecting portion 7b of the weight 7 and the end of the other spring connecting plate 8. The springs 14 and 15 differ from each other in characteristics.

Secured to a lower end portion of the cam cylinder 2 as by force fitting is an ignition advancer plate 11 which is formed therein with slots 12 and 13 adapted to receive therein the rods 9 and 10 secured to the weights 6 and 7 respectively.

The slot 12 formed in the ignition advancer plate 11 has a width which is slightly larger than the outer diameter of the weight rod 9, and has its major axis disposed radially of the cam cylinder 2. On the other hand, the slot 13 adapted to receive therein the weight rod 10 has a width which is much larger than the outer diameter of the rod 10 and is disposed such that there are gaps as indicated at X and the FIG. 1 between longer and shorter sides of the slot 13 formed in the ignition advancer plate 11.

The springs 14 and 15 are designed such that spring 15 has a higher initial tension than spring 14 but spring 14 has a higher spring constant than spring 15.

The weights 6 and 7 are normally urged to move toward the shaft 1 by the initial tensions of the springs 14 and 15. Stoppers 16a and 16b formed integrally with the stoppers 6 and 7 are respectively are brought into engagement with the shaft 1 so as to hold the respective weights 6 and 7 in position.

The weights 6 and 7 are connected at one end portion thereof by the shafts 5, 5 to the weight support member 4 while the spring connecting portions 6a and 7b are provided at the edge of an end portion opposite to the end portion at which the shafts 5, 5 extend through the weights 6 and 7 respectively. Accordingly, when the shaft 1 remains inoperative, the weights 6 and 7 are positioned such that their stoppers 16 and 16b abut against outer periphery of the shaft 1.

Figure 6:
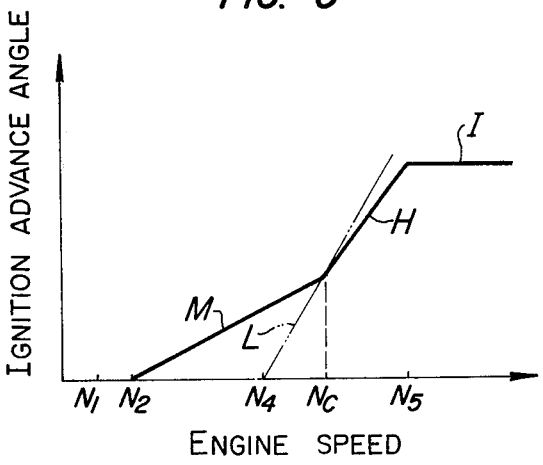
FIG. 6 is a graph showing the ignition advance characteristic obtained by the device of the invention.

The manner of operation of the ignition advancer device constructed as aforementioned will be described. In FIG. 6, the engine speed of an internal combustion engine set forth along the axis of abscissa is plotted against the ignition advance angle set forth along the axis of ordinate. In order that the exhaust gases of the engine may be maintained clean without sacrificing the output power of the engine, the ignition advance characteristic should be such that the ignition advance angle gradually becomes greater as the engine speed exceeds a speed N2 which is slightly higher than an idling speed N1. The increase in the ignition advance angle takes a sharp upward turn at an intermediate engine speed Mc, with the ignition advance angle being maximized at or near a maximum engine speed and kept at that level thereafter as shown in FIG. 6.

The device according to the invention has such ignition advance characteristic. The speed of revolution of the shaft 1 is low at low engine speeds, and the centrifugal forces acting on the weights 6 and 7 are also low. In fact, the centrifugal forces acting on the weights 6 and 7 are lower than the initial tensions of the springs 14 and 15, so that the weights 6 and 7 are kept in a position in which the stoppers 16a and 16b thereof are in engagement with the outer periphery of the shaft 1. Rotation of the shaft 1 is transmitted to the cam cylinder 2 through the weight support member 4, shafts 5, 5, weights 6, 7, rods 9, 10 and ignition advancer plate 11. Thus, the relative positions of the shaft 1 and the cam cylinder 2 remain constant so long as the stoppers **16*a* and 16*b* of the weights 6 and 7 respectively are maintained in contact with the shaft 1, and an ignition signal is produced when the shaft 1 has made one complete revolution to bring a projection on the cam surface 2*b*** to a position in which it is brought into contact with a cam heel of a movable contact of the interruptor (not shown). When this is the case, ignition occurs with a zero ignition advance angle.

Upon the engine speed being increased to N2, the centrifugal force acting on the weight 6 becomes equal to the initial tension of the lower initial tension spring 14. As for the other weight 7, since it is engaged by the spring 15 of higher initial tension, the tension of the spring 15 is higher than the centrifugal force acting thereon at this engine speed.

Upon the engine speed exceeding N2, the weight 6 moves in pivotal motion about its shaft 5 and is displaced in a direction in which it moves away from the shaft 1. This causes the rod 9 to move the ignition advancer plate 11 counter clockwise about the shaft in FIG. 1. That is, the positions of ignition advancer plate 11 and the cam cylinder 2 acting as a unit deviate move through a certain angle in an anticlockwise direction from their initial positions relative to the shaft 1. The amount of this deviation is the ignition advance angle which is in proportion to the engine speed. While the weight 6 is caused to be displaced by the centrifugal force at low engine speeds, the other weight 7 remains in its original positions. The provision of the gaps indicated at X and Y between the rod 10 attached to the weight 7 and the sides of the slot 13 as shown in FIG. 1 enables the ignition advancer plate 11 to move counter clockwise about the shaft 1 without any interference. Thus, the ignition advance characteristic is consistent with the displacement of the weight 6 at low engine speed.

If the engine speed increases and reaches N4, then the centrifugal force acting on the weight 7 becomes equal to the initial tension of the spring 15. Thus, a further increase in engine speed above this level results in displacement of the weight 7. Since the spring constant of the spring 15 is lower than that the spring 14, the rate of increase in the degree of ignition advance caused by the displacement of weight 7 is higher as indicated by a dash-and-dot line L than that caused by the displacement of weight 6. That is, the line L has a greater gradient than the line M in FIG. 6.

Figure 4:
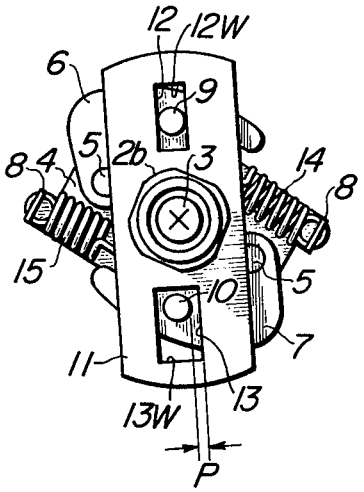
FIG. 4 and FIG. 5 are plan views showing the centrifugal ignition advancer device according to the invention in different stages of ignition advance operation.

When the engine speed reaches N4, the ignition advancer plate 11 has already been advanced or moved by the weight 6 from its position shown in FIG. 1 to its position shown in FIG. 4. Since, however, there is a gap P between a side of the slot 13 and the rod 10 as shown in FIG. 4, the displacement of weight 7 is not transmitted at once to the ignition advancer plate 11.

Figure 5:
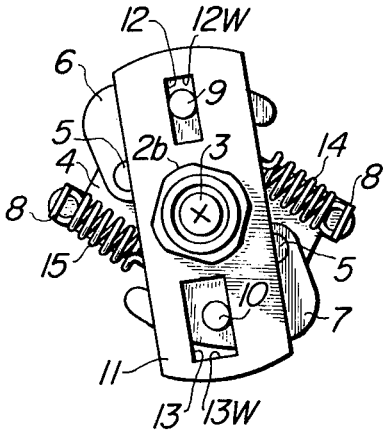

However, if the engine speed exceeds N4, the amount of displacement of weight 7 is greater than that of weight 6 in relation to the increase in engine speed, so that the displacement of one weight becomes equal to that of the other weight when the engine speed reaches Nc. An increase in engine speed over the level Nc results in the amount of displacement of weight 7 becoming greater than that of weight 6. Thus, the ignition advancer plate 11 is moved by the displacement of weight 7, so that the ignition advance characteristic is as indicated by a line H. FIG. 5 shows the state of the device having this ignition advance characteristic. As shown in FIG. 6, the line H has a smaller gradient than the line L. This is accounted for by the fact that, since there is almost no gap between sides of the slot 12 and the rod 9 attached to the weight 6 as shown in FIG. 1, the biasing force of the spring 14 acts in a direction in which it interferes with the displacement of weight 7 as the ignition advancer plate 11 is moved by the displacement of weight 7.

Upon the engine speed exceeding Nc, the ignition advance action is performed by the two weights 6 and 7. Since the spring constant of spring 15 is lower than that of spring 14 as aforementioned, the resultant spring constant of the two springs is lower than twice the spring constant of spring 14. Thus, the gradient of the ignition advance characteristic becomes greater than that of the line M because of the centrifugal forces acting on both the weights 6 and 7. If the engine speed reaches N5, then the weights 6 and 7 are displaced to their maximum displacement positions in which the rods 9 and 10 are brought into contact with outer sides 12W and 13W of the slots 12 and 13 respectively. Thereafter, the ignition advance angle is maintained at the maximum level even if the engine speed further increases. This is indicated by the line I in the ignition advance characteristic shown in FIG. 6.

In the graph of FIG. 6 showing the ignition advance characteristic, the engine speed N2 at which ignition advance commences, the gradient of the lines M and H representing the rates of increases in the degree of ignition advance, and the engine speed Nc at which the ignition advance characteristics undergoes a change may vary in their value requirements depending on the engine. However, the ignition advance commencing point N2 can be varied by adjusting the initial tension of spring 14. That is, adjustments of initial tension can be effected readily by inserting known spring tension adjusting means between the spring 14 and the spring connecting portion of the spring connecting plate 8.

Also, the rate of increase in the degree of ignition advance or the gradient of the line M can be made to meet the requirements of a particular engine by selecting the spring 14 of a suitable spring constant.

The engine speed N4 at which the weight 7 begins to undergo displacement and the rate of increase in the degree of ignition advance at an engine speed which is higher than the point of inflection or the gradient of the line H can be varied in value by varying the initial tension and spring constant of spring 15. The engine speed Nc at the point of inflection can be varied by varying the size of gaps X and Y between the sides of the slot 13 and the rod 10. It will be seen that by effecting adjustments of these factors, it is possible to bring all the values requirements of the ignition advance characteristic to meet the requirements of a particular engine.

If the weight rod 9 and slot 12 are constructed such that the weight rod 9 is brought into engagement with ignition advancer plate 11 when the rod 9 moves in a direction in which the ignition advancer plate 11 is made to advance and that the weight rod 9 is bought out of engagement with the ignition advancer plate 11 when the ignition advancer plate 11 is moved by the other rod 10, and if means were provided for normally urging the ignition advancer plate 11 to move in a direction in which ignition is delayed, it would be possible to let the ignition advance characteristic to follow the line L at an engine speed above the inflection point speed Nc.

Since the slots are very simple in shape, it is possible to obtain smooth performance characteristics if the gaps between the weight rod and the sides of the slot formed in the ignition advancer plate 11 are of a size such that the rod can move in sliding movement without any trouble.

In the embodiment shown and described hereinabove, the slots have been shown as being rectangular in shape. It is to be understood that the invention is not limited to this specific shape of the slots, and that the slots may of any shape as desired so long as the rods can move smoothly in sliding movement.

I claim:

1. A centrifugal ignition advancer device for an ignition system of an internal combustion engine comprising:

a shaft adapted to rotate in conjunction with the operation of the engine;

a pair of weights capable of being displaced by centrifugal forces produced by the rotation of said shaft;

a pair of resilient members each connected to one of said weights so as to restore the respective weights to their original positions against the centrifugal forces, one or the first of said pair of resilient members being higher in spring constant than the other or the second resilient member and connected to the associated weight with a lower initial tension than the second resilient member; and transmission means adapted to cause ignition signal producing means to be displaced in an ignition advance direction relative to said shaft when said weights are displaced either singly or in combination, the ignition signal producing means adapted to be rendered operative to effect ignition advances upon the first weight undergoing displacement when the first weight connected to said first resilient member is displaced and the second weight connected to said second resilient member is not displaced.

2. A device as claimed in claim 1 wherein said transmission means comprises rods each attached to one of said pair of weights, and an ignition advancer plate secured to a cam cylinder forming a part of the ignition signal producing means, said ignition advancer plate being formed therein with a pair of slots each adapted to receive therein one of said rods, one of said slots for receiving therein the rod attached to said second weight being of a size such that there are gaps between sides of the slot and the rod so as to allow movement of said ignition advancer plate through a predetermined angle in an ignition advance diection.

3. A centrifugal ignition advancer device for an ignition system of an internal combustion engine comprising:

a weight support member;

a pair of weights each pivotally supported by a shaft connected to said weight support member;

an ignition advancer plate connected to ignition signal producing means and formed therein with slots each adapted to receive therein one of weight rods each attached to one of said pair of weights so as to allow the weight rods to move in sliding movement along sides of said slots; and resilient means mounted between said weight support member and said pair of weights, said resilient means comprising two resilient members differing from each other in initial tension and spring constant and one of said slots and the weight rod received therein being arranged such that there are gaps of predetermined sizes between the weight rod and sides of the slot, whereby ignition advance can be effected by means of the weight associated with the resilient member of lower initial tension till the engine speed reaches a predetermined level while the weight rod associated with the resilient member of higher initial tension is idling in the slot and ignition advance is effected by the two weights when the engine speed exceeds the predetermined level.

* * * * *